United States Patent [19]

Avery

[11] 4,200,132

[45] Apr. 29, 1980

[54] MOISTURE PROOF BAG CLOSURE

[76] Inventor: John R. Avery, 3558 Forest St., Denver, Colo. 80207

[21] Appl. No.: 11,876

[22] Filed: Feb. 13, 1979

[51] Int. Cl.[2] ..... B65D 33/24

[52] U.S. Cl. ..... 150/7

[58] Field of Search ..... 150/3, 7, 5; 206/260, 206/269; 229/62, 65, 80

[56] References Cited

U.S. PATENT DOCUMENTS

| | | | |
|---|---|---|---|
| 753,063 | 2/1904 | Goodridge | 150/7 |
| 1,138,305 | 5/1915 | Miller | 150/7 UX |
| 2,161,474 | 6/1939 | Klein | 206/260 X |
| 2,709,815 | 6/1955 | Nelson | 150/7 X |
| 3,536,189 | 10/1970 | Gallagher | 229/65 X |
| 3,696,917 | 10/1972 | Levi | 150/5 X |

FOREIGN PATENT DOCUMENTS

| | | | |
|---|---|---|---|
| 460341 | 11/1950 | Italy | 150/7 |

*Primary Examiner*—Donald F. Norton

*Attorney, Agent, or Firm*—Sheridan, Ross, Fields & McIntosh

[57] ABSTRACT

A container is provided having an improved sealing arrangement to prevent the entry of moisture into the container and the escape of moisture therefrom when it is used to hold a moisture-containing substance. The container includes a first and a second wall integrally joined together along their side and bottom margins while their top margins are separable to form an open container. The first and second walls include a lower portion to house an article and an upper portion to be wrapped into a spiral seal formation. A pair of vertically spaced, elongated closure strips extend laterally across and are secured to the inner surface of the upper portion of the first wall. A first flap member is connected along its edge to the outer surface of the first wall while a second flap member is connected along its edge to the outer surface of the second wall. The flap members include a plurality of snap members. To seal the container, the closure strips are folded over each other in parallel laterally adjacent relation to fold and pinch the upper portion of the second wall. The upper portions of the walls are then wrapped into a spiral formation. The first and second flap members are positioned to surround the spiral seal at its outermost layer. The snap members are connected together at a position contiguously above the spiral formation to maintain the spiral sealing arrangement. Thus, forces acting to unwrap the spiral seal formation are shear forces against which the snap members offer great resistance.

9 Claims, 6 Drawing Figures

MOISTURE PROOF BAG CLOSURE

DESCRIPTION

1. Technical Field

This invention relates to containers for housing articles and protecting them from moisture. Particularly, the invention is directed to a container having an improved sealing arrangement to prevent moisture from entering as well as escaping from the container.

2. Background Art

Containers have been developed previously in which an upper portion of the container has been wrapped in a spiral formation while a fastening mechanism is used to maintain the spiral. In U.S. Pat. No. 753,063 to Goodridge a water bottle is provided having an upper portion wound in a spiral formation with a buckle attachment to maintain the spiral. In my co-pending U.S. patent applications, Ser. No. 780,714 filed Mar. 24, 1977 and entitled "Container for Fragile Articles" and Ser. No. 910,228 filed May 30, 1978 and entitled "Container for Fragile Articles", containers are disclosed having a single flexible strip connected to the upper portion of the wall of the container which is wrapped in a spiral formation. Various sealing arrangements are also disclosed in a number of references related to tobacco containing pouches. Examples of such pouches are found in U.S. Pat. No. 2,161,474 to Klein and U.S. Pat. No. 3,696,917 to Levi. However, the present invention provides a sealing configuration in which a pair of closure strips are connected to a first wall of a double wall container. The strips are positioned in parallel lateral adjacent relation to fold and pinch a second wall prior to wrapping the upper portions of the container into a spiral formation. Furthermore, the fastening arrangement of this invention minimizes the likelihood that forces acting to unwrap the spiral seal will be successful. The fasteners disclosed herein are snaps which strongly oppose shear forces while offering considerably less resistance to forces acting parallel to the aligning axis of the snaps. The snaps of this invention are arranged so that forces tending to unwind the spiral seal are substantially shear forces. Consequently, the snaps provide high resistance to such shear forces and thereby minimize the possbility that the snaps will disengage. This fastening configuration is in contract to connecting arrangements, such as shown in my previously identified co-pending applications, in which forces acting to unwrap the spiral seal are substantially parallel to the aligning axis of the fasteners.

DISCLOSURE OF INVENTION

In accordance with this invention, a container is provided for preventing entry of moisture thereto. The container includes a pair of generally rectangular walls integrally joined together along three sides and opened at the fourth side. The walls each include a lower portion for housing an article and an upper portion which is wrapped in a spiral formation after placing the article in the container. The upper portion of a first wall has a pair of narrow, elongated closure strips parallel vertically spaced from each other and which are folded over each other in parallel laterally adjacent relation prior to the forming of the spiral seal so that the upper portion of a second wall is folded and a part of the second wall is pinched between the pair of closure strips to provide a moisure tight seal. Mounted on each of the walls is a flap member having a plurality of snap members which are provided to releasably engage each other after the flap members surround the spiral formed seal in order that the spiral formation be maintained.

More particularly, the invention comprises a container having a first wall and a second wall. The walls are integrally joined at their side and bottom margins while the top margins are separable to provide an opening to the container. Each of the walls includes an upper portion and a lower portion. A first flap member is fixedly secured along its attaching edge to the outer surface of the first wall. The first flap member extends laterally across the first wall and includes a plurality of snap members spaced along the longitudinal axis of the first flap member and secured thereto. A second flap member is fixedly secured along its attaching edge to the outer surface of the second wall. The second flap member extends laterally across the second wall and also includes a plurality of snap members spaced along the longitudinal axis of the second flap member and secured thereto. The attaching edges of the first and second flap members are intermediate the lower and upper portions of the walls and are generally connected to the walls in parallel alignment. The upper portion of the first wall includes a pair of thin, narrow closure strips which extend laterally across the inner surface of the first wall. The closure strips are vertically parallel spaced from each other. A containing wall overlies the closure strips and is integrally joined to the inner surface of the first wall to secure the closure strips between the inner surface of the first wall and the containing wall.

To seal the container, the closure strips are folded over each other so that elongated sides of the closure strips are laterally adjacent and portions of the second wall are pinched or squeezed between the pair of closure strips to provide a tight seal. The upper portions of the first and second walls are then wrapped in a spiral formation while the flap members are used to surround the spiral formed seal. The snap members are then connected together contiguously overlying the longitudinal axis of the spiral seal to maintain that seal formation.

Thus, the advantages of this invention are readily apparent. A container having an improved sealing arrangement is provided which is of simple construction. In addition, fastening snaps are provided above a spiral formed seal to strongly resist shear forces therein which act to unwrap the sprial formation. Furthermore, the spiral seal with closure strips is quickly and easily formed to prevent the entry of moisture into the container.

BEST MODE FOR CARRYING OUT THE INVENTION

Figure 1:
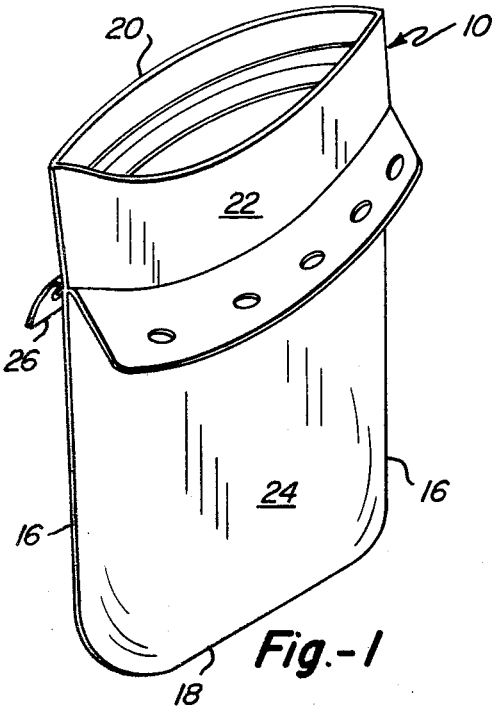
FIG. 1 is a perspective view of an opened sealable container showing the closure strips of this invention.

Referring with particularity to the drawings, FIG. 1 shows a container or bag 10 made of a flexible material, such as transparent polyvinyl. Container 10 includes a first wall 12 and a second wall 14 joined integrally together along their side margins 16 and bottom margins 18. Top margins 20 are openable to permit entry of an article which is to be housed in the container 10. Walls 12, 14 are generally rectangular and can be flattened together when container 10 is empty.

Figure 3:
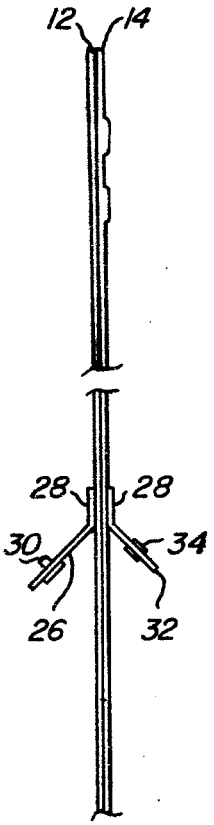
FIG. 3 is a fragmentary, side elevational view of the container in its closed position closed and the snap members projecting from the container.
Figure 4:
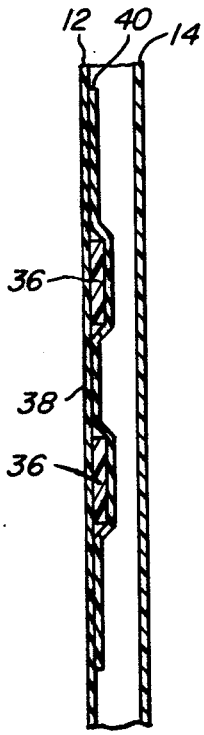
FIG. 4 is an enlarged, fragmentary, longitudinal section along line 4—4 of FIG. 2 showing details of the closure strips.

Each of the walls 12, 14 includes an upper portion 22 and a lower portion 24. Intermediate the upper portion 22 and lower portion 24 of first wall 12 is a first flap member 26. First flap membetr 26 includes an attaching edge 28 which extends laterally across first wall 12 and which connects to the outer surface of first wall 12 to secure first flap member 26 thereto. First flap member 26 projects outwardly from first wall 12, as best seen in FIG. 3. A plurality of first snap members 30 are fixedly mounted on the first flap member 26 along an axis extending laterally of first wall 12 and which is also defined as the longitudinal axis of the first flap member 26.

Intermediate the upper portion 22 and lower portion 24 of second wall 14 is a second flap member 32. Second flap member 32 extends laterally across second wall 14 and also has an attaching edge 28 which connects to the outer surface of second wall 14 to secure second flap member 32 thereto. Second flap member 32 also projects outwardly from second wall 14, as shown in FIG. 3. Second flap member 32 is of a lesser vertical dimension than first flap member 26 to facilitate the fastening operation to be explained more fully later. A plurality of spaced second snap members 34 are fixedly mounted on second flap member 32 along an axis which extends laterally of the second wall 14 and which is also defined as the longitudinal axis of the second flap member 32. Also seen in FIG. 3, the attaching edges 28 are secured to the first and second walls 12, 14 in parallel alignment, that is, the vertical distance from top margins 20 to attaching edge 28 of the first wall 12 is the same as the vertical distance from top margins 20 to attaching edge 28 of second wall 14.

Figure 2:
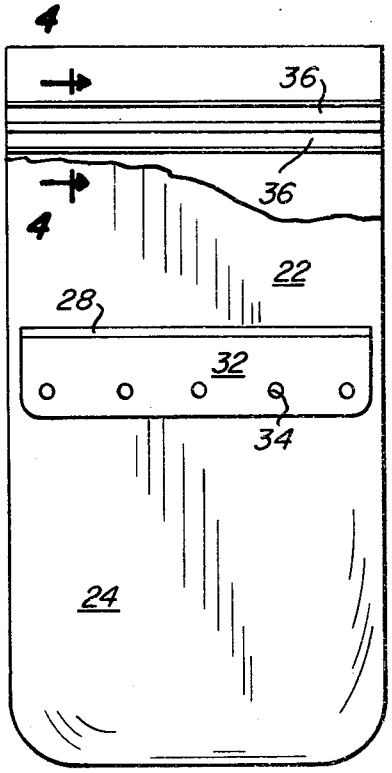
FIG. 2 is a front elevational view, partially cut away, showing the sealable container with closure strips.

First wall 12 also includes a pair of relatively thin, elongated closure strips 36, as illustrated in FIG. 2. Closure strips 36 are positioned vertically parallel with respect to each other so that a space 38 is provided therebetween. Strips 36 are made of a flexible substance, such as a soft, resilient plastic foam, and are positioned contiguously adjacent the inner surface of the first wall 12 a distance below the top margin 20 of container 10. A containing wall 40 overlies longitudinal sides of the closure strips 36 which are opposite the longitudinal sides adjacent the inner surface of the first wall 12 to secure the closure strips 36 to the inner surface of first wall 12. Containing wall 40 extends laterally across the inner surface of first wall 12 and is vertically extensive between parts of upper portion 22 of first wall 12 to contiguously overlie both closure strips 36 and space 38.

Figure 5:
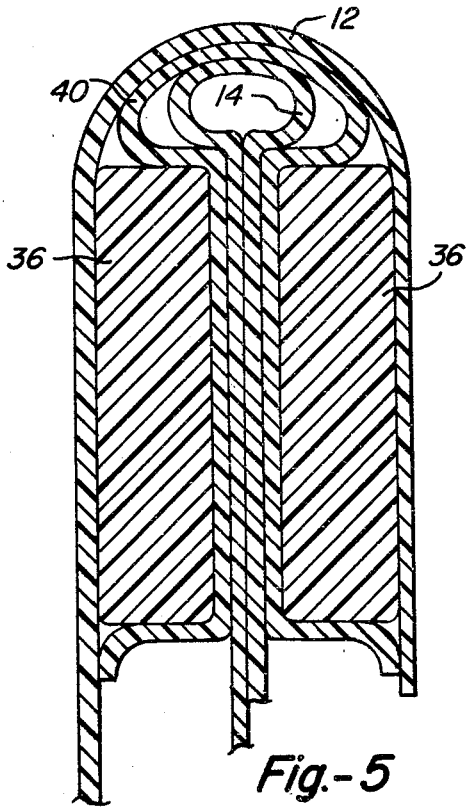
FIG. 5 is a greatly enlarged, fragmentary, longitudinal section showing the two closure strips in parallel laterally adjacent relation.

To seal the container 10, the upper portions 22 of the walls 12, 14 are first brought together so that their inner surfaces are in contiguous sealing relation. The closure strips 36 are then folded over each other so that the closure strip 36, which is positioned relatively more adjacent to the top margins 20, is moved laterally adjacent the other closure strip 36 along its longitudinal side thereby pinch sealing or squeezing portions of the second wall 14 between the closure strips 36. The fold is provided in a first direction such that the second wall 14 is inwardly positioned with respect to the first wall 12, as shown in FIG. 5. The fold is made in the first direction because containing wall 40 produces a bend at space 38 so that the folding action is facilitated when the closure strips 36 are doubled over in the first direction. This bend is formed because of the thickness of the closure strips 36 which is greater than the thickness of the first wall 12 at space 38 since it does not include the closure strips 36. Although the folding of the closure strips 36 is shown in a first direction, in the preferred folding arrangement, the fold could be made in a second direction opposite to the first direction such that second wall 14 is outwardly positioned with respect to first wall 12. A tight seal can be provided upon wrapping the upper portions of the walls into a spiral and maintaining the spiral formation by fastening the same. However, greater resistance to the folding action is present because the bend itself opposes movement in the second direction and the second wall 14 is not pinched or squeezed between the closure strips 36 in this configuration.

Figure 6:
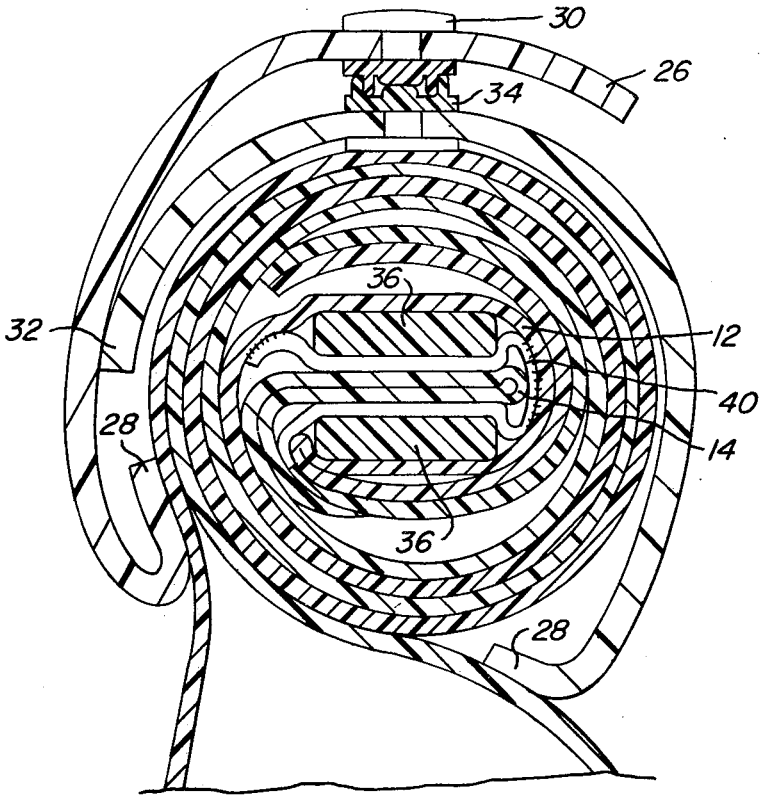
FIG. 6 is a greatly enlarged, fragmentary, longitudinal section showing the upper portion of the container, including the closure strips, wrapped in a spiral formation.

The folding action in the first direction places the longitudinal sides of closure strips 36 in parallel laterally adjacent relation and provides a tight seal. Subsequently, sections of the upper portions 22 of the walls 12, 14 and the closure strips 36 are wrapped or continuously folded to form a spiral seal, which is best depicted in FIG. 6. The wrapping operation continues until the attaching edges 28 of the first and second flap members 26, 32 are reached. The second flap member 32 is then rotated along it attaching edge 28 to overlie a portion of the outer surface or layer of the spiral seal while the first flap member 28 is subsequently rotated along its attaching edge 28 in a direction opposite to that of the second flap member 32 so that it overlies the remaining portion of the outer surface of the spiral seal. The first flap member 26 also overlies a portion of the second flap member 32 so that the first snap members 30 are axially aligned with and can be releasably connected to the second snap members 34 upon application of a force generally parallel to their aligning axis. These surrounding and locking features secure the moisture tight spiral seal and prevent it from unwrapping.

As seen in FIG. 6, the first snap members 30 and the second snap members 34 are joined adjacently above the longitudinal axis of the spiral seal which extends laterally in relation to the walls 12, 14. The snap members 30, 34 are characterized by the physical property of strongly opposing shear forces acting to disengage them while offering relatively less resistance to forces acting substantially parallel to their aligning axis. Thus, positioning of the snap members 30, 34 adjacently above the spiral seal minimizes the possibility that they will disengage since forces tending to disengage the snap members 30, 34 are st bstantially shear forces against which the snap members 30, 34 provide great resistance.

From the foregoing, the advantages of this invention are easily discerned. A container is provided which is readily constructed with an improved sealing arrangement which substantially prevents moisture from entering the container because one wall of the container is pinch sealed. In addition, this sealing arrangement substantially prevents the escape of moisture from the container when it is desirable to maintain moisture therein and it is obviously understood that any reference herein to the advantage of the sealing arrangement whereby it prevents entry of moisture into the container is also applicable to the advantage of preventing the escape of moisture therefrom. The container seal also includes a spiral formation surrounding which is a fastening arrangement that minimizes the likelihood that forces will act to disconnect snap members since such forces are shear forces against which the snap members provide great resistance.

The invention has been described in detail with particular reference to a particular embodiment thereof, but it will be understood that variations and modifications can be effected within the spirit and scope of the invention.

I claim:

1. A container having a sealing arrangement for minimizing the entry of moisture thereto, and the escaping of moisture therefrom, said container comprising:

a bag made of flexible material openable along a portion thereof and including a first wall and a second wall formed to engage each other in sealing relation;

a pair of spaced closure strips connected to said first wall with each of said strips extending laterally thereacross, said first and second walls being foldable when in engagement with each other, so that said closure strips are positioned in parallel adjacent relation to pinch seal said second wall between said pair of spaced closure strips and thereby substantially prevent moisture from entering said bag along the pinch seal; and fastening means for holding the pinch seal after the folding of said closure strips.

2. A container having a sealing arrangement for minimizing the entry of moisture thereto, and the escaping of moisture therefrom, said container comprising:

a bag made of a flexible material openable along a portion thereof and including a first wall and a second wall, said walls being formed to engage each other in sealing relation and portions thereof being wrapped into a spiral formation about an axis extending laterally of the container to press said first and second walls together tightly in sealing relation;

a pair of spaced closure strips connected to said first wall, said first and second walls being foldable when in engagement with each other but prior to the wrapping of portions of said first and second walls into the spiral formation, so that said closure strips are positioned in parallel adjacent relation to pinch seal said second wall between said pair of spaced closure strips; and fastening means for holding the pinch seal and the spiral formation to maintain the sealing relation and thereby substantially prevent moisture from entering said bag.

3. The container, as claimed in claims 1 or 2, wherein:

said closure strips are vertically parallel spaced from each other and extend laterally across an inner surface of said first wall.

4. The container, as claimed in claims 1 or 2, further including:

a containing wall extending laterally across said closure strips and connected to said first wall to secure said closure strips thereto.

5. The container, as claimed in claim 2, wherein:

said fastening means includes a pair of flap members to overlie the spiral formation, each of said flap members having a snap member alignable and connectable with each other directly above the spiral formation so that unwrapping of the spiral formation due to shear forces acting therein is minimized.

6. A flexible container with a sealing arrangement for minimizing the entry of moisture thereto, said container comprising:

a first wall including an upper portion and a lower portion and having bottom, side, and top margins;

a second wall including an upper portion and a lower portion and having bottom, side, and top margins, said bottom and side margins are integrally joined to said bottom and side margins of said first wall while said top margins of said first and second walls are open to form the container and said upper portions of said first and second walls are formed to engage each other in sealing relation and to be wrapped into a spiral formation about an axis extending laterally of the container to press said first and second walls together tightly in sealing relation;

a pair of vertically spaced closure strips, each of said closure strips having elongated sides extending laterally across said upper portions of said first wall and connected thereto, said elongated sides of said closure strips being in parallel adjacent relation prior to the wrapping of said upper portions of said first and second walls into a spiral formation to pinch seal said second wall;

a first flap member to overlie a portion of the spiral formation and including an attaching edge extending laterally across the outer surface of said first wall and secured thereto;

a second flap member to overlie a portion of the spiral formation so that said first and second flap members together surround the outer surface of the spiral formation and including an attaching edge extending laterally across the outer surface of said second wall and secured thereto;

a plurality of spaced first snap members fixedly mounted on said first flap member; and a plurality of spaced second snap members fixedly mounted on said second flap member to releasably connect to said first snap members directly above the spiral formation so that unwrappingg of the spiral formation due to shear forces acting therein is minimized.

7. A container having a sealing arrangement for minimizing the entry of moisture thereto, and the escaping of moisture therefrom, said container comprising:

a bag made of flexible material openable along a portion thereof and including a first wall and a second wall formed to directly engage each other in sealing relation;

a pair of vertically spaced closure strips connected to said first wall, said first and second walls being foldable after directly engaging each other, so that said closure strips are positioned in laterally adjacent relation to pinch seal said second wall between said pair of spaced closure strips and thereby substantially prevent moisture from entering said bag along the pinch seal; and fastening means for holding the pinch seal after the folding of said closure strips.

8. The container, as claimed in claim 7, wherein:

said closure strips are fixedly connected to said first wall.

9. A container having a sealing arrangement for minimizing the entry of moisture thereto, and the escaping of moisture therefrom, said container comprising:

a bag made of a flexible material opening along a portion thereof and including a first wall and a second wall, said walls being formed to engage each other in sealing relation and portions thereof being wrapped into a spiral formation about an axis extending laterally of the container to press said first and second walls together tightly in sealing relation;

a pair of spaced closure strips connected to said first wall and each of said strips extending laterally thereacross; and fastening means for holding the spiral formation and including a pair of flap members to overlie the spiral formation, each of said flap members having a snap member alignable and connectable with each other directly above the spiral formation so that unwrapping of the spiral formation due to shear forces acting therein is minimized.

* * * * *